US007611210B2

(12) United States Patent
Majagi et al.

(10) Patent No.: US 7,611,210 B2
(45) Date of Patent: Nov. 3, 2009

(54) CUTTING BIT BODY AND METHOD FOR MAKING THE SAME

(75) Inventors: Shivanand I. Majagi, Rogers, AR (US); Ronald C. Keating, Pittsburgh, PA (US); Anirudda S. Marathe, Bentonville, AR (US)

(73) Assignee: Kennametal Inc., Latrobe, PA (US)

( * ) Notice: Subject to any disclaimer, the term of this patent is extended or adjusted under 35 U.S.C. 154(b) by 9 days.

(21) Appl. No.: 11/507,214

(22) Filed: Aug. 21, 2006

(65) Prior Publication Data

US 2008/0042484 A1 Feb. 21, 2008

(51) Int. Cl.
*E21C 35/18* (2006.01)

(52) U.S. Cl. ..... 299/111; 299/113

(58) Field of Classification Search ..... 299/106, 299/113, 111, 95, 107, 108
See application file for complete search history.

(56) References Cited

U.S. PATENT DOCUMENTS 4,277,106 A * 7/1981 Sahley ..... 299/111
4,484,644 A * 11/1984 Cook et al. ..... 175/420.1
5,261,499 A * 11/1993 Grubb ..... 299/107
6,073,518 A * 6/2000 Chow et al. ..... 76/108.2
6,478,383 B1 11/2002 Ojanen et al.
2003/0209366 A1* 11/2003 McAlvain ..... 175/427

FOREIGN PATENT DOCUMENTS

JP 2896749 * 12/1999

OTHER PUBLICATIONS

MPIF Standard 35 "Iron-Nickel and Nickel Steel", P/M Structual Material Section 2003 (p. 14).
MPIF Standard 35 "Low Alloy Steel", P/M Structual Material Section 2003 (p. 16).
MPIF Standard 35 "Sinter Hardened Steel", P/M Structual Material Section 2003 (p. 18).
MPIF Standard 35 "Diffusion Alloyed Steel", P/M Structual Material Section 2003 (p. 20).
MPIF Standard 35 "Copper Infiltrated Iron and Steel", P/M Structual Material Section 2003 (p. 22).
MPIF Standard 35 "Stainless Steel—300 Series Alloy", P/M Structual Material Section 2003 (p. 24).
MPIF Standard 35 "Stainless Steel—400 Series Alloy", P/M Structual Material Section 2003 (p. 26).

* cited by examiner

*Primary Examiner*—John Kreck
(74) *Attorney, Agent, or Firm*—Matthew W. Smith

(57) ABSTRACT

A cutting bit body that is a part of a cutting bit that includes a hard insert that is affixed to the cutting bit body and wherein the cutting bit impinges earth strata. The cutting bit body is an elongate powder metallurgical body member. A method for making a powder metallurgical cutting bit body that includes the steps of: providing a powder mixture; pressing the powder mixture into a green cutting bit body compact having a partial density; and consolidating the green body to form the powder metallurgical cutting bit body.

8 Claims, 5 Drawing Sheets

CUTTING BIT BODY AND METHOD FOR MAKING THE SAME

BACKGROUND OF THE INVENTION

The present invention pertains to a cutting bit body, as well as a cutting bit using such cutting bit body, and a method of making the cutting bit body. More specifically, the present invention pertains to a cutting bit body for a cutting bit used for mining (e.g., coal mining), drilling (e.g., roof drilling in coal mining operations) and construction (e.g., road planing) applications, and a method for making the same, wherein the entire cutting bit body is a powder metallurgical body or at least one component of the cutting bit body is a powder metallurgical component.

Heretofore, conventional cutting bits used for mining and construction applications have included an elongate steel cutting bit body. Such cutting bits have also included a hard insert affixed to the axial forward end of the cutting bit body. The cutting bit is retained (in a rotatable fashion or in a non-rotatable fashion) at its axial rearward end to a holder or block During operation such as, for example, in a road planning application, the holder or block carrying the cutting bit is driven toward to impinge the earth strata thereby breaking or disintegrating the earth strata. As can be appreciated, severe forces exerted on the cutting bits and especially the cutting bit bodies. It is thus important that the cutting bit body possess optimum properties suitable to withstand such a severe operating environment for an acceptable duration.

The typical cutting bit body used in a cutting bit for mining and construction applications has an elongate steel body that is made via either conventional forging techniques or conventional casting techniques. While conventional forging or casting techniques produce a satisfactory steel cutting bit body, there are certain drawbacks connected with such a conventional steel cutting bit body.

Some of these drawbacks pertain to the method of manufacturing the cutting bit body. In this regard, the conventional steel body typically requires machining in order to complete the manufacture of the steel body. As one example, machining is the typical process used to form the socket in the axial forward end of the cutting bit body. While machining produces a satisfactory socket, there exist certain limitations or restrictions on the ability to machine (at least without undue costs or even at any cost) a socket of a relatively complex geometry to accommodate a hard insert of a complex geometry. Thus, it can be appreciated that it would be desirable to provide a cutting bit body made by near net shape manufacturing, as well as a method making the same, that does not need or require any machining, or requires only a minimal amount of machining, to complete the manufacture of the cutting bit body.

The properties of the cutting bit body impact the ability of the cutting bit to adequately withstand the severe operating environments inherent with mining and construction applications. The microstructure, the composition and the design of the cutting bit body help define the properties of the cutting bit body.

In regard to the microstructure of the cutting bit body, although current cutting bit bodies exhibit acceptable microstructures, it would be beneficial to provide a cutting bit body, as well as a method for making the same, that provides a cutting bit body with an improved microstructure such as for example, the microstructure would be more isotropic. It would also be desirable to provide a cutting bit body, as well as a method for making the same, that provides for flexibility in selecting the microstructure of the cutting bit body. In this regard, the cutting bit body would have a microstructure with different microstructural regions wherein each such region would have different properties. Thus, it would be desirable to provide a cutting bit body, as well as a method for making the same, that exhibits an improved microstructure including a more isotropic microstructure, as well as a microstructure with more design flexibility.

In regard to the composition of the cutting bit body, although current cutting bit bodies exhibit acceptable compositions, it would be beneficial to provide a cutting bit body, as well as a method for making the same, that provides a cutting bit body with an improved composition. Exemplary compositions would be those that have heretofore not been feasible using conventional forging or casting techniques. Other exemplary compositions would be certain ceramics and cermets that have heretofore been unavailable for use as a cutting bit body.

In regard to the design of the cutting bit body, although current designs of cutting bit bodies are acceptable, there exist certain drawbacks. Conventional cutting bodies are of a monolithic one-piece construction. Such a construction for a cutting bit body results in inherent restrictions on the design flexibility of the cutting bit body. It can therefore be appreciated that it would be desirable to provide a cutting bit body for a cutting bit that provides for improved design flexibility without current inherent restrictions. For example, it would be beneficial to provide a cutting bit body that would comprise a plurality of components to thereby expand the potential designs for the steel body. These components would take on any one of many geometries to provide enhanced properties for the cutting bit using such cutting bit body.

SUMMARY OF THE INVENTION

In one form thereof, the invention is a cutting bit body for a cutting bit that impinges the earth strata wherein the cutting bit comprises a hard insert that is affixed to the cutting bit body. The cutting bit body comprises an elongate powder metallurgical body member.

In another form thereof, the invention is a cutting bit body for a cutting bit that impinges the earth strata wherein the cutting bit comprises a hard insert that is affixed to the cutting bit body. The cutting bit body comprises a plurality of cutting bit body components. At least one of the cutting bit body components is a powder metallurgical cutting bit body component.

In another form thereof, the invention is an earth cutting tool that comprises a hard insert that is affixed to an elongate powder metallurgical body member.

In another form thereof, the invention is a cutting bit for impinging on earth strata. The cutting bit comprises a hard insert that is affixed to a cutting bit body. The cutting bit body comprises a plurality of cutting bit body components wherein at least one of the cutting bit body components is a powder metallurgical cutting bit body component.

In yet another form thereof, the invention is a method for making a powder metallurgical cutting bit body comprising the steps of: providing a powder mixture; pressing the powder mixture into a green cutting bit body compact having a partial density; and consolidating the green body to form the powder metallurgical cutting bit body.

In still another form thereof, the invention is a method for making a cutting bit body comprising the steps of: providing a powder metallurgical cutting bit body component; providing a conventionally-made cutting bit body component; and joining together the powder metallurgical cutting bit body component and the conventionally-made cutting bit body component.

In another form thereof, the invention is a method for making a powder metallurgical cutting bit body comprising the steps of: providing a first powder mixture located at a first location; providing a second powder mixture located at a second location, and wherein the first powder mixture is different from the second powder mixture; pressing the first powder mixture and second powder mixture into a green cutting bit body compact having a partial density; and consolidating the green body to form the powder metallurgical cutting bit body wherein the first powder mixture forms a first region of the cutting bit body and the second powder mixture forms a second region of the cutting bit body.

BRIEF DESCRIPTION OF THE DRAWINGS

The following is a brief description of the drawings that form a part of this patent application.

DETAILED DESCRIPTION

Figure 1:
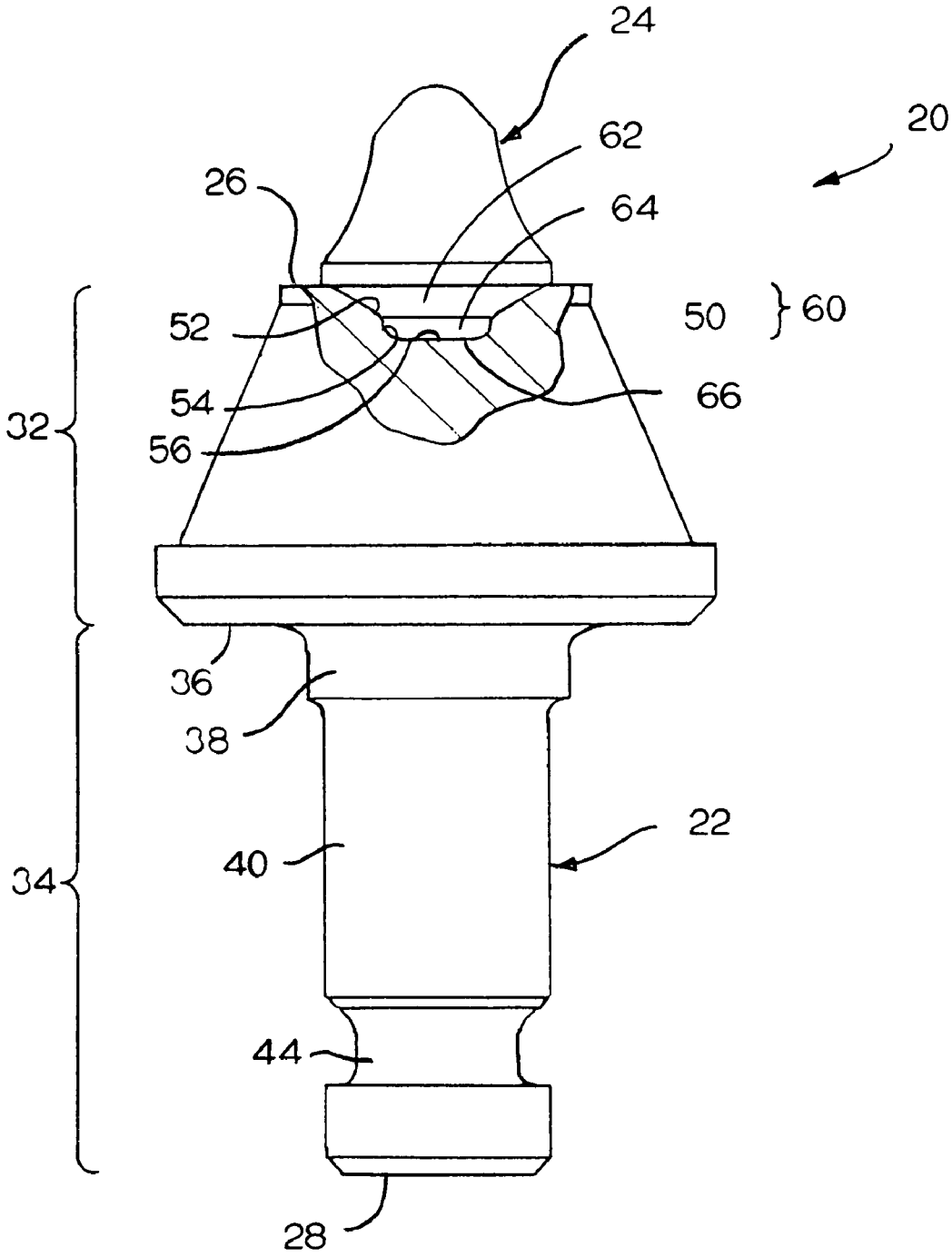
FIG. 1 is a side view of a first specific embodiment of a conical-style cutting bit of the invention having a powder metallurgical steel body, and a section of the steel body has been cut away near the axial forward end of the steel body to expose the socket that contains the hard carbide insert affixed within the socket.

Referring to the drawings, FIG. 1 is a side view of a rotatable conical-style cutting bit, which is a first specific embodiment of the invention, generally designated as 20. It must be appreciated that rotatable conical-style cutting bit 20 is but one type of cutting bit. Applicants contemplate that the invention is applicable to a wide range of cutting bits including without limitation other styles of rotatable cutting bits (including without limitation roof drill bits) and non-rotatable cutting bits. Applicants contemplate that the invention is also applicable to symmetric cutting bits, i.e., a cutting bit that is symmetric about its central longitudinal axis, and asymmetric cutting bits, i.e., a cutting bit that is asymmetric about its central longitudinal axis.

Cutting bit 20 comprises an elongate steel body 22 and a hard insert 24. The steel body 22 has an axial forward end 26 and an axial rearward end 28. The steel body 22 comprises a head portion (see bracket 32) adjacent to the axial forward end 26 and a shank portion (see bracket 34) adjacent to the axial rearward end 28. The head potion 32 has a rearward facing shoulder 36 that defines a rearward termination of the head portion 32. The shank portion 34 has a larger diameter transition section 38 and a smaller diameter tail section 40. The tail section 40 contains an annular groove 44.

The head portion 32 contains a socket generally designated as 50 in the axial forward end 26 of the steel body 22. Socket 50 has a frusto-conical surface 52 that opens at the axial forward end 26 of the bit body 22. Further, the frusto-conical surface 52 is axial forward of and contiguous with a cylindrical surface 54, and the cylindrical surface 54 is axial forward of and contiguous with a bottom surface 56. The bottom surface 56 defines the rearward termination of the socket 50.

The hard insert 24 includes a lower valve seat portion (see bracket 60). The valve seat portion 60 has a frusto-conical surface 62, a cylindrical surface 64 and a bottom surface 66 that correspond with the frusto-conical surface 52, the cylindrical surface 54 and the bottom surface 56 of the socket 50, respectively, when the hard insert 24 is received within the socket 50. The hard insert 24 is affixed within the socket 50 by brazing or the like using braze alloys known to those skilled in the art. It should be appreciated that the interface between the socket 50 and the hard insert 24 may comprise any one of a variety of shapes including (without limitation) a planar interface between the socket 50 and the hard insert 24.

The cutting bit body 22 is a powder metallurgical component. What this means is that at least one stage of the manufacturing process (or method) to make this cutting bit body 22 used a powder metallurgical technique. A more detailed description of certain processes or methods to make the powder metallurgical cutting bit body is set forth below.

One method for making the powder metallurgical cutting bit body comprises the following steps. The first step is to provide a powder mixture. Typically, the powder components, as well as binder in some cases, are mixed or blended into the powder mixture. The powder mixture is then pressed into a green cutting bit body compact having a partial density. Although the dimensions are such to allow for shrinkage during the upcoming sintering (or consolidation) step, the green cutting bit body exhibits the basic geometry of the cutting bit body. The green cutting bit body compact is then consolidated (e.g., sintered) to form the fully dense powder metallurgical cutting bit body. The consolidation typically occurs under heat or under heat and pressure. The consolidation temperature and pressure can vary depending upon the specific composition of the powder mixture.

Another method to make the powder metallurgical cutting bit body uses a fully dense sintered ingot or billet. Here, the powder metallurgical ingot is made via a powder metallurgical technique like that described above. The powder metallurgical ingot is then machined to form the cutting bit body.

Still another method to make the powder metallurgical cutting bit body uses a fully dense sintered ingot or billet. Here, the powder metallurgical ingot is made via a powder metallurgical technique like that described above. The powder metallurgical ingot is then forged to form the cutting bit body.

Figure 4:
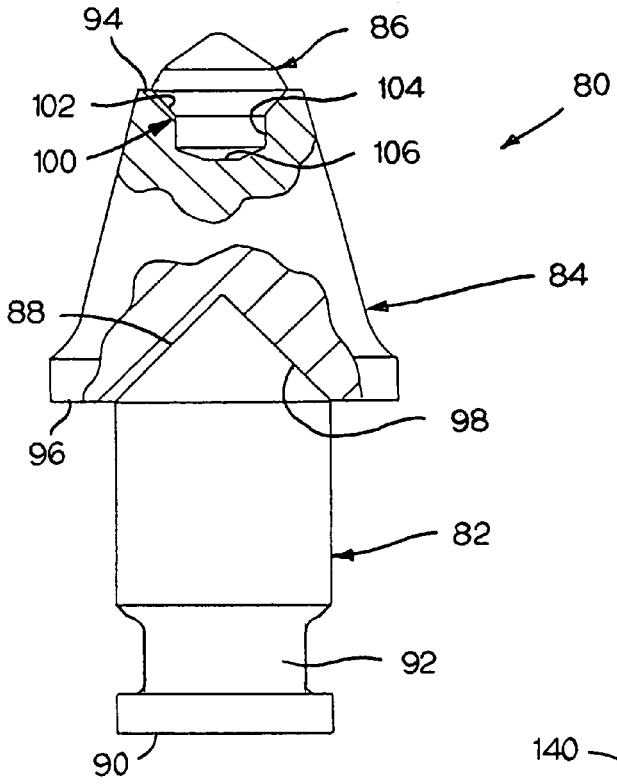
FIG. 4 is a side view of a second specific embodiment of a conical-style cutting bit of the invention having a forged component and a powder metallurgical component, and the powder metallurgical component is cut-away to expose the socket that receives the hard carbide insert and an axial rearward conical socket that receives the forged component.

Referring to FIG. 4, there is shown a side view of a second specific embodiment of a cutting bit of the invention generally designated as 80. Cutting bit 80 comprises three basic components; namely, an elongate steel shank generally designated as 82, a steel head portion generally designated as 84, and a hard insert generally designated as 86. The elongate steel shank 82 is a forged component. Although the elongate steel shank could be a cast component.

The steel head portion 84 is a powder metallurgical component, i.e., a component made via a powder metallurgical technique. Like for the powder metallurgical cutting bit body, what this means is that at least one stage of the manufacturing process (or method) to make this component used a powder metallurgical technique. A more detailed description of certain processes or methods to make the powder metallurgical component is set forth below.

One method for making the powder metallurgical component comprises the following steps. The first step is to provide a powder mixture. Typically, the powder constituents, as well as binder in some cases, are mixed or blended into the powder mixture. The powder mixture is then pressed into a green component compact having a partial density. Although the dimensions are such to allow for shrinkage during the upcoming sintering (or consolidation) step, the green component exhibits the basic geometry of the component. The green component compact is then consolidated (e.g., sintered) to form the fully dense powder metallurgical component. The consolidation typically occurs under heat or under heat and pressure. The consolidation temperature and pressure can vary depending upon the specific composition of the powder mixture.

Another method to make the powder metallurgical component uses a fully dense sintered ingot or billet. Here, the powder metallurgical ingot is made via a powder metallurgical technique like that described above. The powder metallurgical ingot is then machined to form the powder metallurgical component. Still another method to make the powder metallurgical component uses a fully dense sintered ingot or billet made via a powder metallurgical technique like that described above. The powder metallurgical ingot is then forged to form the powder metallurgical component.

The elongate steel shank 82 has an axial forward end 88 and an axial rearward end 90. The axial forward end 88 presents the shape of a cone. The shank 82 contains an annular groove 92 adjacent to the axial reward end 90 thereof. The head portion 84 has an axial forward end 94 and an axial rearward end 96. The head portion 84 contains a conical socket 98 in the axial rearward end 96 thereof.

As can be appreciated, the head portion 84 and the shank portion 82 are affixed together (such as, for example, by brazing) at the joint defined by the interface between the conical socket 98 and the conical axial forward end 88, respectively. Although one common method to join the components is via brazing, it should be appreciated that certain geometries at the interface may provide for the mechanical interlocking of the components. In addition, the welding (about 400° C.) or the use of adhesives at lower temperatures could be used to affix together the components. Further, it should be appreciated that the conical geometry of the forward end 88 of the shank 82 and the socket 98 of the head portion 84 are but illustrative. Applicants contemplate that many other geometric shapes could be used to provide the interface between these components.

The head portion 84 further contains a socket 100 in the axial forward end 94 thereof. Socket 100 is designed to receive the hard insert 86. Socket 100 includes a frusto-conical surface 102 that opens at the axial forward end 94 of the head portion 84. Further, the frusto-conical surface 102 is axial forward of and contiguous with a cylindrical surface 104, and the cylindrical surface 104 is axial forward of and contiguous with a bottom surface 106. The bottom surface 106 defines the rearward termination of the socket 100.

Along the general geometric lines of the hard insert 24, the hard insert 86 includes a valve seat portion. The valve seat portion has a frusto-conical surface, a cylindrical surface and a bottom surface that correspond with the frusto-conical surface 102, the cylindrical surface 104 and the bottom surface 106 of the socket 100, respectively, when the hard insert 86 is received within the socket 100. It should be appreciated that the interface between the socket 100 and the hard insert 86 may comprise any one of a variety of shapes including (without limitation) a planar interface between the socket 100 and the hard insert 86.

Still referring to the specific embodiment illustrated in FIG. 4, the steel shank 82 is a forged part, but it should be appreciated that it could be made via powder metallurgical techniques. The head portion 84 is made via powder metallurgical techniques wherein the typical material is a steel alloy. The hard insert 86 is made via powder metallurgical techniques wherein the typical material is a hard carbide alloy such as, for example, cobalt cemented tungsten carbide.

Figure 5:
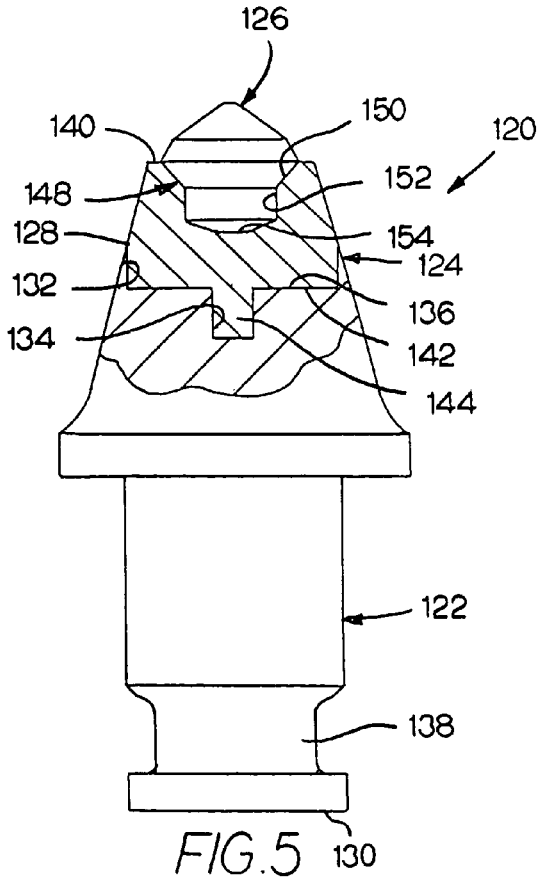
FIG. 5 is a side view of a third specific embodiment of a conical-style cutting bit of the invention having a first powder metallurgical component and a second powder metallurgical component, and wherein each one of the powder metallurgical components is cut-away to expose the structure at the joinder thereof, as well as the socket that receives the hard carbide insert.

Referring to FIG. 5, there is shown a side view of a third specific embodiment of a conical-style cutting bit generally designated as 120. Cutting bit 120 comprises three basic components; namely, an elongate steel body generally designated as 122, a steel head portion generally designated as 124, and a hard insert generally designated as 126. Each one of the elongate steel body 122 and the steel head portion 124 is a powder metallurgical component.

The elongate steel body 122 has an axial forward end 128 and an axial rearward end 130. The steel body 122 contains a socket 132 at the axial forward end 128 thereof. The steel body 122 further includes an elongate closed-end hole 134 that is open at the bottom surface 136 of the socket 132. The steel body 122 further includes a groove 138 adjacent to the axial rearward end 130 thereof.

The head portion 124 has an axial forward end 140 and an axial rearward end 142. Head portion 124 includes a post 144 that projects away from the surface of the axial rearward end 142. Head portion 124 also contains a socket generally designated as 148 at the axial forward end 140 thereof. The socket 148 includes a frusto-conical surface 150 that opens at the axial forward end 140 of the head portion 124. Further, the frusto-conical surface 150 is axial forward of and contiguous with a cylindrical surface 152, and the cylindrical surface 152 is axial forward of and contiguous with a bottom surface 154. The bottom surface 154 defines the rearward termination of the socket 148.

Along the general geometric lines of the hard insert 24, the hard insert 126 includes a valve seat portion. The valve seat portion has a frusto-conical surface, a cylindrical surface and a bottom surface that correspond with the frusto-conical surface 150, the cylindrical surface 152 and the bottom surface 154 of the socket 148, respectively, when the hard insert 126 is received within the socket 148.

Still referring to the specific embodiment illustrated in FIG. 5, the steel shank 122 and the head portion 124 are each made via powder metallurgical techniques wherein the typical material is a steel alloy suitable for use in a cutting bit. The hard insert 126 is made via powder metallurgical techniques wherein the typical material is a hard carbide alloy such as, for example, cobalt cemented tungsten carbide.

As can be appreciated, the head portion 124 and the shank portion 122 are affixed together (such as, for example, by brazing) at the joint defined by the interface between these components. More specifically, the post 144 is received within the hole 134 and the bottom surface 142 of the head portion 124 sits on the bottom surface 136 of the socket 132. Thus, the interface between the head portion 124 and the shank portion 122 is defined by the joint between the corresponding surfaces of the post 144 and the bottom surface 142 of the head portion 124 and the hole 134 and bottom surface 136 of the socket 132. Although one common method to join the components is via brazing, it should be appreciated that certain geometries at the interface may provide for the mechanical interlocking of the components. In addition, the welding (about 400° C.) or the use of adhesives at lower temperatures could be used to affix together the components. Further, it should be appreciated that the specific geometry of the post and the hole used to join the head portion and the shank portion is but illustrative. Applicants contemplate that many other geometric shapes could be used to provide the interface between these components.

Figure 6:
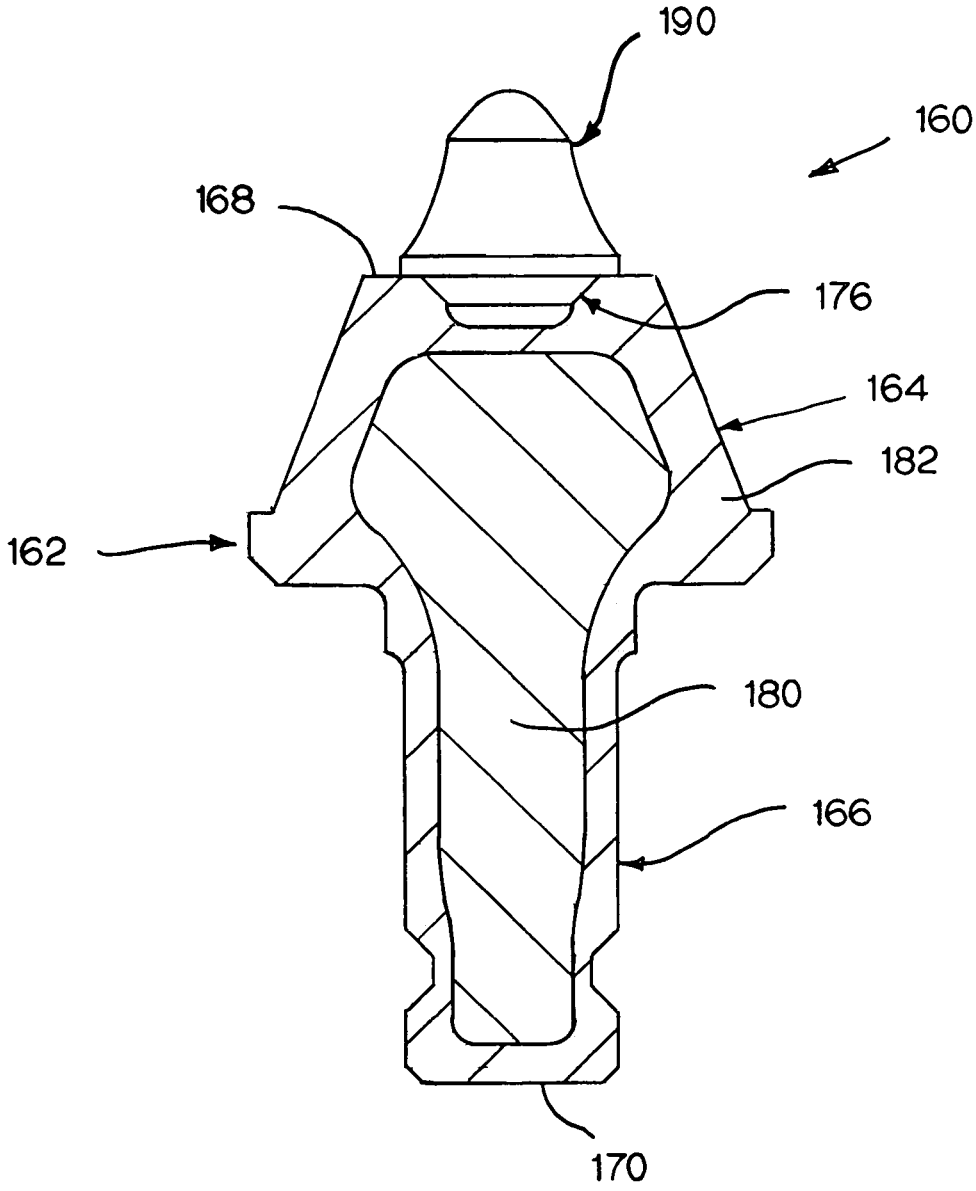
FIG. 6 is a side cross-sectional view of a fourth specific embodiment of a conical style-cutting bit of the invention having a central powder metallurgical region and an outer powder metallurgical region bonded thereto.

Referring, to FIG. 6, there is illustrated a fourth specific embodiment of a conical-type cutting bit of the invention generally designated as 160. Cutting bit 160 has an elongate cutting bit body generally designated as 162. Cutting bit body 162 has a head portion 164 adjacent to the axial forward end 168 of the body 162 and a shank 166 adjacent to the axial rearward end 170 of the cutting bit body 162. The cutting bit body 162 contains a socket 176 in the axial forward end 168 thereof. A hard insert 190 is brazed within the socket 176 to be affixed to the cutting bit body 162.

The cutting bit body 162 has a central powder metallurgical region 180. The central region 180 is made via a powder metallurgical technique. The cutting bit body 162 further includes an outer powder metallurgical region 182 that surrounds the central region 180. The outer region 182 is also made via a powder metallurgical technique. The central region 180 and the outer region 182 will be distinct from one another. The distinctness between these regions can be due to a difference in composition. For example, even though both regions comprise a steel composition, one region may include a greater content of alloying elements. The distinctness between regions can be due to a difference in microstructure, e.g., grain size of one or more components, even if the overall composition is generally the same.

Due to the flexibility associated with using powder metallurgical techniques, different approaches can be used to form the central region 180 and the outer region 182. In one approach, the central region 180 may be a fully dense sintered member wherein the powder mixture for the outer region is placed about the fully dense sintered member to form a composite with the central region and the outer region. This composite then consolidated to form the cutting bit body 162. In another approach, the central region may be from a green member wherein the powder mixture for the outer region is placed about the green member to form a composite. This composite is then consolidated to form the cutting bit body with the central region and the outer region. It should also be appreciated that more than two distinct regions can exist in the cutting bit body and the locations thereof can vary to meet the requirements of specific applications.

In reference to the typical compositions of the components, the hard inserts (24, 86, 126, 190) are typically made via powder metallurgical techniques from a hard material. Exemplary hard materials include without limitation cobalt cemented tungsten carbide. Cobalt cemented tungsten carbide alloys are tungsten carbide-based with cobalt (or a cobalt alloy) as the primary binder material. Other binders could include nickel and its alloys, iron and its alloys, and combinations thereof. It should also be appreciated that the hard material could also include additives such as, for example, tantalum, niobium, vanadium, chromium and the like. Typical hard material compositions are shown and described in Brookes, World Directory and Handbook of Hardmetals and Hard Materials $6^{th}$ Edition, (1996), International Carbide Data, East Barnet Hertfordshire EN4 8DN, U.K., as well as in U.S. Pat. No. 6,478,383 to Ojanen for a Rotatable Cutting Tool-Tool Holder Assembly (assigned to Kennametal Inc.).

For the components of the cutting bit body made via a powder metallurgical technique, a typical material is a steel alloy. Suitable steel alloys can have the following compositions: a carbon content that varies between about 0.01 weight percent and about 0.6 weight percent; a boron content that can be up to about 0.2 weight percent; and a phosphorous content that is less than about 0.2 weight percent. The steel alloy may also include one or more of the following other alloying elements in a total amount up to about 20 weight percent: nickel (Ni), chromium (Cr), molybdenum (Mo), silicon (Si), vanadium (V), aluminum (Al), and titanium (Ti). Applicants also contemplate that other steel alloys such as, for example, those listed in Tables 1 and 2 would be suitable for the powder metallurgical component(s) of the cutting bit body or the entire powder metallurgical cutting bit body. Applicants further contemplate that iron-based alloy containing at least 30 weight percent iron would be suitable for the powder metallurgical component(s) of the cutting bit body or the entire powder metallurgical cutting bit body.

For conventional components that are forged or cast, suitable steel alloys include (without limitation) the alloys listed in Table 2 below.

Figure 7:
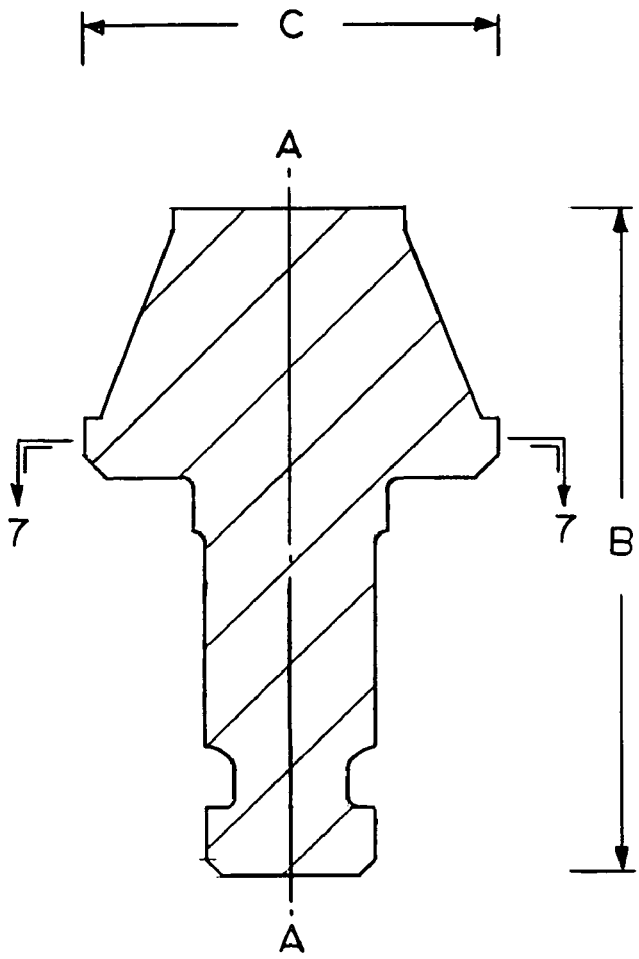
FIG. 7 is a cross-sectional view of the cutting bit body of the cutting bit of FIG. 1 taken along a central longitudinal axis A-A.
Figure 8:
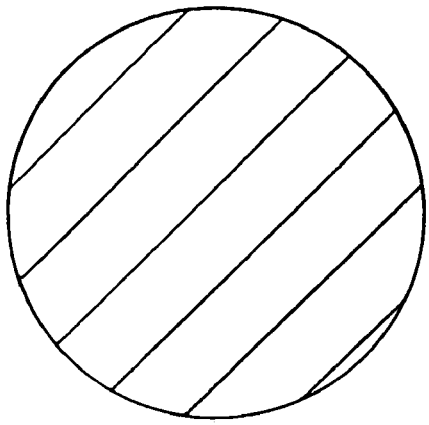
FIG. 8 is a cross-sectional view of the largest diameter portion of the cutting bit body of the cutting bit of FIG. 1 taken along section line 7-7.

Referring to FIGS. 7 and 8, it should be appreciated that certain design advantages exist due to the use of powder metallurgical techniques to form one or more steel components or the entire steel cutting bit body. In this regard, the ratio of the maximum height (see dimension "B" of cutting bit body illustrated in FIG. 7) to the maximum diameter (see dimension "C" of the cutting bit body illustrated in FIG. 7) of the assembled steel body can range between about one to about ten. As one alternative, this ratio of the maximum height (see dimension "B" of cutting bit body illustrated in FIG. 7) to the maximum diameter (see dimension "C" of the cutting bit body illustrated in FIG. 7) of the assembled steel body can range between about two to about eight. The ratio of the area of the assembled steel body taken along the vertical cross-section through the central longitudinal axis A-A thereof to the largest transverse (to the central longitudinal axis) cross-sectional area of the assembled steel body can range between about one to about ten, and as an alternative, this ratio can range between about 1.25 to about 8. More specifically, the area of the assembled steel body taken along the vertical cross-section through the central longitudinal axis A-A is equal to the area of the cross-section of FIG. 7. The largest transverse (to the central longitudinal axis) cross-sectional area of the assembled steel body is equal to the area shown in FIG. 8.

Applicants have made an example of the cutting bit body that exhibits a geometry along the lines of the geometry shown in FIG. 1. More specifically, geometry of the steel body is like the forged steel body for use in the Kennametal RP06 conical-style cutting bit. The RP06 cutting bit that uses the forged steel body is made and sold by Kennametal Inc. of Latrobe, Pa. 15650.

To make the example of the cutting bit body, applicants first made a powder metallurgical ingot of steel alloy powder. In this regard, a mixture of the steel powder was pressed into a green compact having the general elonagte shape of an ingot. The green compact was then sintered at a temperature between about 2000° F. (1093° C.) and about 2200° F. (1204° C.) for a duration between about 5 seconds and 2 hours at a pressure between about 80 pounds per square inch (psi) (4137 torr) and about 30,000 psi (1,551,448 torr). The powder metallurgical ingot was then machined into the geometry of the Kennametal RP06 steel body. The composition of the steel alloy was 0.51 weight percent carbon; 0.95 weight percent manganese; 1.22 weight percent chromium; 0.24 weight percent molybdenum; a maximum of 0.008 weight percent sulfur; 0.015 weight percent phosphorous; and the balance iron and other expected impurities.

Figure 2:
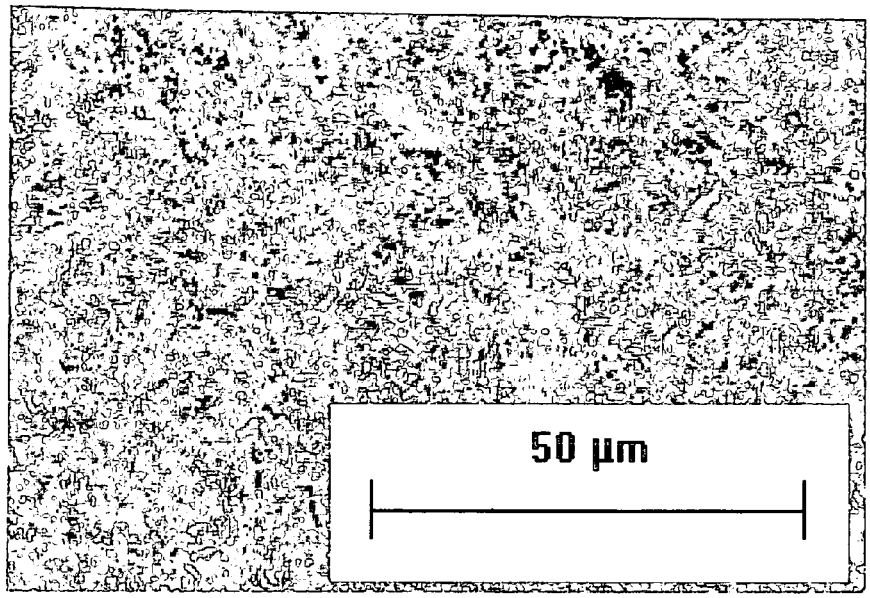
FIG. 2 is a photomicrograph (which has a 50 micrometers legend) of the microstructure of Example No. 1.
Figure 3:
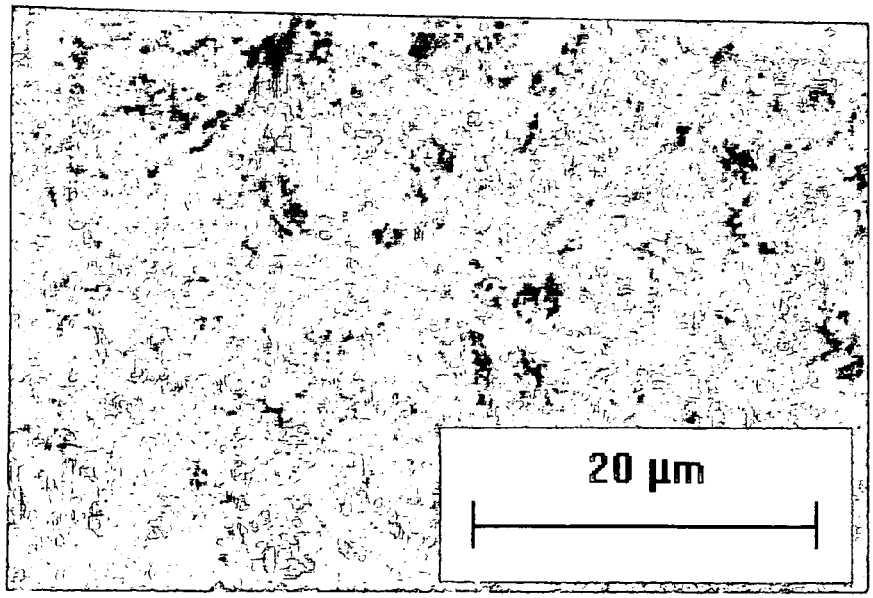
FIG. 3 is a photomicrograph (which has a 20 micrometers legend) of the microstructure of Example No. 1.

FIG. 2 is a photomicrograph (50 μm scale) that illustrates the microstructure of the as-sintered steel bit body of Example No. 1. FIG. 2 shows that an isotropic microstructure with a uniformity in appearance, a uniformity in the distribution of inclusions, a micro-segregation of the solute particles, and no dendritic structure. FIG. 3 is a photomicrograph (20 μm scale) that illustrates the microstructure of the steel bit body of Example No. 1, except that it is at a different magnification. FIG. 3 confirms the observations of the microstructure from FIG. 2. The hardness of the steel body of Example No. 1 was measured using a Wilson hardness tester and was found to be equal to 55 Rockwell C ($HR_C$).

In a comparison of the microstructure of the cutting bit body Example No. 1 against what is known of the microstructure of conventional cutting bit bodies, it appears that the microstructure of Example No. 1 exhibits improved distribution of inclusions.

Applicants contemplate that the sintering parameters can range as follows: the sintering temperature can range between about 0.70 and about 0.95 of the melting point of the powder mixture, the sintering duration can range between about 5 seconds and about 150 minutes, and the pressure can range between about 50 psi (2586 torr) and about 30,000 psi (1,551,448 torr).

In reference to steel alloy compositions, applicants consider the following steel alloys listed in Table 1 to be suitable for the manufacture of steel alloy components of cutting bits using powder metallurgical techniques.

TABLE 1

Steel Alloys (MPIF Designations) Suitable for Manufacture of Components of Cutting Bits Via Powder Metallurgical Techniques

| Alloy | C % | Mn % | Ni % | Cr % | Mo % | Cu % | S % | P % | Si % | Fe |
|---|---|---|---|---|---|---|---|---|---|---|
| P/F-10XX | 0.20-0.60 | 0.10-0.25 | 0.10 max | 0.10 max | 0.05 max | 0.3 max | 0.025 max | 0.03 max | 0.03 max | Balance |
| P/F-11XX | 0.20-0.60 | 0.30-0.60 | 0.10 max | 0.10 max | 0.05 max | 0.3 max | 0.23 max | 0.03 max | 0.03 max | Balance |
| P/F-42XX | 0.20-0.60 | 0.20-0.35 | 0.40-0.50 | 0.10 max | 0.55-0.65 | 0.15 max | 0.03 max | 0.03 max | 0.03 max | Balance |
| P/F-46XX | 0.20-0.80 | 0.10-0.25 | 1.75-2.00 | 0.10 max | 0.50-0.60 | 0.15 max | 0.03 max | 0.03 max | 0.03 max | Balance |
| F-0000 | 0.0-0.3 | — | — | — | — | — | — | — | — | Balance |
| F-0005 | 0.3-0.6 | — | — | — | — | — | — | — | — | Balance |
| F-0008 | 0.6-0.9 | — | — | — | — | — | — | — | — | Balance |
| FC-0200 | 0.0-0.3 | — | — | — | — | 1.5-3.9 | — | — | — | Balance |
| FC-0205 | 0.3-0.6 | — | — | — | — | 1.5-3.9 | — | — | — | Balance |
| FC-0208 | 0.6-0.9 | — | — | — | — | 1.5-3.9 | — | — | — | Balance |
| FC-0505 | 0.3-0.6 | — | — | — | — | 4.0-6.0 | — | — | — | Balance |
| FC-0508 | 0.6-0.9 | — | — | — | — | 4.0-6.0 | — | — | — | Balance |
| FC-0808 | 0.6-0.9 | — | — | — | — | 7.0-9.0 | — | — | — | Balance |

The alloys listed in Table 1 are according to MPIF (Metal Powders Industry Federation, Princeton, N.J. 08540) Standard 35. The compositions are set forth in weight percent.

More preferred steel alloy compositions (in weight percent) useful for the manufacture of steel alloy components of cutting bits using powder metallurgical techniques are listed in Table 2.

TABLE 2

More Preferred Steel Alloys (Weight Percent) Suitable for Manufacture of Components of Cutting Bits Via Powder Metallurgical Techniques

| Alloy | C % | Mn % | Ni % | Cr % | Mo % | S % | P % | Si % | Other % | Fe |
|---|---|---|---|---|---|---|---|---|---|---|
| 15B37 | 0.30-0.39 | 1.00-1.50 | — | — | — | 0.03 max | 0.03 max | .15-.35 | B = .0005-.003 | Balance |
| 10XX | 0.2-0.7 | 1% max | — | — | — | 0.03 max | 0.03 max | 0.15-0.35 | — | Balance |

TABLE 2-continued

| | More Preferred Steel Alloys (Weight Percent) Suitable for Manufacture of Components of Cutting Bits Via Powder Metallurgical Techniques | | | | | | | | | |
|---|---|---|---|---|---|---|---|---|---|---|
| Alloy | C % | Mn % | Ni % | Cr % | Mo % | S % | P % | Si % | Other % | Fe |
| 4140 | 0.38-0.43 | 0.75-1.00 | — | 0.8-1.1 | 0.15-0.25 | 0.03 max | 0.03 max | 0.15-0.35 | — | Balance |
| 8637 | 0.35-0.40 | 0.75-1.00 | 0.40-0.70 | 0.40-0.60 | 0.15-0.25 | 0.03 max | 0.03 max | 0.15-0.35 | — | Balance |
| 8740 | 0.38-0.43 | 0.75-1.00 | 0.40-0.70 | 0.40-0.60 | 0.20-0.30 | 0.03 max | 0.03 max | 0.15-0.35 | — | Balance |
| ASTM A228 | 0.70-1.00 | 0.20-0.60 | — | — | — | 0.03 max | 0.03 max | 0.15-0.35 | — | Balance |
| ASTM A227 | 0.45-0.85 | 0.30-1.30 | — | — | — | 0.03 max | 0.03 max | 0.15-0.35 | — | Balance |
| ASTM A229 | 0.55-0.85 | 0.30-1.20 | | | | 0.03 max | 0.03 max | 0.15-0.35 | — | Balance |
| ASTM A230 | 0.60-0.75 | 0.60-0.90 | — | — | — | 0.03 max | 0.03 max | 0.15-0.35 | — | Balance |
| ASTM A231 A232 | 0.48-0.53 | — | — | 0.80-1.00 | — | 0.03 max | 0.03 max | 0.15-0.35 | V = 0.15 minimum | Balance |
| ASTM A878 | 0.60-0.75 | — | — | 0.35-0.60 | — | 0.03 max | 0.03 max | 0.15-0.35 | V = 0.10-0.25 | Balance |
| ASTM A877 A401 | 0.51-0.59 | — | — | 0.60-0.80 | — | 0.03 max | 0.03 max | 0.15-0.35 | Si = 1.20-1.60 | Balance |

It is apparent from the above description that applicants have invented an improved cutting bit body, as well as a method for making a cutting bit body, wherein the entire or at least one component of the cutting bit body is made via a powder metallurgical technique. This invention provides advantages with respect to the manufacture of the cutting bit body. This invention also provides advantages connected with the microstructure, the geometric design and composition of the cutting bit body. These advantages should lead to an improvement in the performance of the cutting bit that uses the cutting bit body of the invention.

By providing the versatility and flexibility in the manufacture of the components of the steel body via powder metallurgical techniques, the present invention allows for the near net shape manufacture of those components (or the entire steel body) that present geometries that heretofore would have required machining to produce. Hence, the cutting bit body does not need or require machining or at the most, requires only a minimal amount of machining. For example, powder metallurgical techniques increase the design flexibility with respect to the socket that receives the hard insert, as well as other features of the cutting bit body. These sockets (as well as other features of the cutting bit body) can thus exhibit an increase in geometric complexity.

It is also apparent that the present invention provides for an increase in the flexibility in choosing the microstructure of the cutting bit body, the composition of the cutting bit body, and the geometric design of one or more features of the cutting bit body. Such flexibility provides meaningful advantages.

It is apparent that the present invention provides a cutting bit body, as well as a method for making a cutting bit body, that exhibits an improved microstructure such as for example, the microstructure would be more isotropic. It is also apparent that the present invention provides a cutting bit body, and method for making a cutting bit body, wherein the cutting bit body would have a microstructure with different microstructural regions wherein each such region would have different properties.

It is apparent that the present invention provides a cutting bit body, as well as a method for making a cutting bit body, wherein the composition of the cutting bit body can be improved due to the use of powder metallurgical techniques. Exemplary compositions would be those that have heretofore not been feasible using conventional techniques and would include without limitation certain ceramics and cermets that have heretofore been unavailable for use as a cutting bit body.

It is further apparent that the present invention provides a cutting bit body that comprises multiple components (including powder metallurgical components) to thereby expand the potential designs for the cutting bit body. More specifically, by providing a multi-component steel body, there exists flexibility in the geometric design of the components to enhance the performance of the cutting bit. Through design flexibility, the composition can be varied to be particularly suited for selected areas of the cutting bit such as, for example, in more wear-resistant composition can be positioned in those areas exposed to extreme erosion or wear. By using powder metallurgical techniques to produce some components, the microstructure in certain areas of the body can be enhanced which leads to an improvement in performance.

Further, it is apparent that the use of a multi-component body can allow for the selective positioning of the joints between the components to increase the strength of the overall body. The use of a multi-component steel body also can lead to a reduction in the manufacturing costs of the cutting bit, especially if certain machining or assembly steps can be made easier or eliminated from the overall manufacturing process.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A method for making a cutting bit body comprising the steps of:

providing a fully sintered powder metallurgical cutting bit body component formed by consolidating a green powder metallurgical compact into the fully sintered powder metallurgical cutting bit body component, and wherein the powder metallurgical cutting bit body component comprises an iron-based alloy having at least about 30 weight percent iron;

providing a conventionally-made cutting bit body component, and wherein the conventionally-made cutting bit body component comprises an iron-based alloy having at least about 30 weight percent iron;

placing the fully sintered powder metallurgical cutting bit body component into direct physical contact with the conventionally-made cutting bit body component; and joining together the fully sintered powder metallurgical cutting bit body component and the conventionally-made cutting bit body component.

2. The method according to claim 1 wherein the step of providing the fully sintered powder metallurgical cutting bit body component further includes removing material from a fully sintered powder metallurgical body.

3. The method according to claim 1 wherein the step of providing the fully sintered powder metallurgical cutting bit body component deforming a fully sintered powder metallurgical body.

4. The method according to claim 1 wherein the conventionally-made cutting bit body component is made by forging.

5. The method according to claim 1 wherein the conventionally-made cutting bit body component is made by casting.

6. A method for making a powder metallurgical cutting bit body comprising the steps of:

providing a first powder mixture consisting essentially of steel of a first composition located at a first location;

providing a second powder mixture consisting essentially of steel of a second composition located at a second location;

pressing the first powder mixture and second powder mixture into a green cutting bit body compact having a partial density; and consolidating the green body to form the powder metallurgical cutting bit body wherein the first powder mixture forms a first region of the cutting bit body and the second powder mixture forms a second region of the cutting bit body.

7. The method according to claim 6 wherein the first powder mixture is an iron-based alloy having at least about 30 weight percent iron.

8. The method according to claim 6 wherein the second powder mixture is an iron-based alloy having at least about 30 weight percent iron.

* * * * *